US005255842A

United States Patent [19]

Rosén

[11] Patent Number: 5,255,842

[45] Date of Patent: Oct. 26, 1993

[54] STRENGTHENED EDGE PACKAGING CONTAINERS

[75] Inventor: Ake Rosén, Helsingborg, Sweden

[73] Assignee: Tetra Alfa Holdings S.A., Pully, Switzerland

[21] Appl. No.: 845,585

[22] Filed: Mar. 4, 1992

[30] Foreign Application Priority Data

Mar. 7, 1991 [SE] Sweden ..... 9100678

[51] Int. Cl.[5] ..... B65D 5/42

[52] U.S. Cl. ..... 229/137; 229/3.1; 229/930

[58] Field of Search ..... 229/3.1, 117.12, 137, 229/918, 919, DIG. 4, DIG. 11

[56] References Cited

U.S. PATENT DOCUMENTS

| | | | |
|---|---|---|---|
| 944,536 | 12/1909 | Bonfield et al. | 229/DIG. 4 |
| 1,821,668 | 9/1931 | Ross | 229/DIG. 4 |
| 2,015,148 | 9/1935 | Knowlton | 229/DIG. 4 |
| 2,673,678 | 3/1954 | Morton . | |
| 2,792,166 | 5/1957 | Brooks . | |
| 3,024,961 | 3/1962 | Galloway | 229/DIG. 4 |
| 3,140,810 | 7/1964 | Goodrich | 229/DIG. 4 |
| 3,197,112 | 7/1965 | Meyer-Jagenberg | 229/137 |
| 3,232,516 | 2/1966 | Arslanian | 229/125.42 |
| 3,237,838 | 3/1966 | Elias | 229/DIG. 4 |
| 3,462,067 | 8/1969 | Shore . | |
| 3,526,566 | 9/1970 | McIlvain, Jr. et al. | 229/DIG. 4 |
| 3,727,825 | 4/1973 | Troth | 229/DIG. 4 |
| 4,096,987 | 6/1978 | Rodish | 229/DIG. 4 |
| 4,874,125 | 10/1989 | Bates | 229/DIG. 11 |

FOREIGN PATENT DOCUMENTS

| | | |
|---|---|---|
| 353496 | 2/1990 | European Pat. Off. . |
| 353991 | 2/1990 | European Pat. Off. . |
| 1939041 | 2/1971 | Fed. Rep. of Germany . |
| 2649065 | 5/1977 | Fed. Rep. of Germany . |
| 210576 | 1/1967 | Sweden . |
| 312521 | 7/1969 | Sweden . |
| 1470238 | 4/1977 | United Kingdom . |

OTHER PUBLICATIONS

McGraw-Hill Dictionary of Scientific and Technical Terms, p. 1171 (4th ed. 1989).

Modern Plastics Encyclopedia '91, vol. 67, No. 11, pp. 381-382 (1990).

*Primary Examiner*—Gary E. Elkins

*Attorney, Agent, or Firm*—Burns, Doane, Swecker & Mathis

[57] ABSTRACT

A packaging container is manufactured through fold forming, vacuum forming, injection molding or other processing to shape a plastically deformable, flexible material, comprising a tubular container body with two longitudinal edges which delimit between them a mainly flat container wall. In order to prevent deformation and/or cracking of the packaging container with normal handling of the side walls, the packaging container is provided with reinforcing elements formed through plastic deformation of the wall material in the region of the longitudinal edges. The reinforcing elements strengthen and stiffen the container and enable it to be conveniently gripped with the hand without the risk of the edges and/or the adjacent side walls being cracked or deformed.

19 Claims, 2 Drawing Sheets

STRENGTHENED EDGE PACKAGING CONTAINERS

FIELD OF THE INVENTION

The present invention relates to packaging containers and, more particularly, relates to packaging containers manufactured through fold forming or other shape processing.

BACKGROUND

The present invention concerns a packaging container manufactured through fold forming or other processing to shape a plastically deformable, flexible material, of the type which exhibits a tubular container body with two or more longitudinal edges which delimit between them in pairs a mainly flat side wall in the container.

A packaging container of the type which is described above is known through EP-A-O 353 991 and EP-A-O 353 496. The material in these known packaging containers exhibits one or more skeletal layers of plastic and filler mixed in the plastic, and possibly also one or more further layers laminated to the skeletal layer with the aim of giving the material the desired sealing properties, e.g. an Al foil which gives the material excellent gas-tight properties.

The known packaging containers are manufactured either from a strip of from a prefabricated substance of the material, through fold forming and sealing with the aid of modern, rational packaging machines of the type which both shapes, fills and closes the finished packagings.

From, for example, a strip with a pattern of fold lines facilitating fold forming and a decoration in line with the pattern of fold lines, packaging containers are manufactured through the strip first being shaped into a tube through the two longitudinal edges of the strip being joined to each other in an overlap joint. The tube is filled with the contents in question and divided into closed, filled packaging units through repeated transverse sealings of the tube across the longitudinal direction of the tube below the level of contents of the tube. The cushion shaped packaging units are separated from each other through cuts in the transverse sealing zones and given the desired geometric, generally parallelepiped-shaped final form through a final shaping and sealing operation during which the two upper double-wall triangular corner flaps of the packaging containers are bent down towards and sealed to the packaging container's respective adjacent side walls and the two lower double-wall triangular corner flaps of the packaging containers are bent in towards and sealed to the packaging container's flat bottom. A well known example of such a parallelepiped shaped packaging is Tetra Brik (reg. trade mark).

From a prefabricated flat material provided with fold lines a, packaging containers are manufactured through the material first being formed into a tube with square, rectangular or any other desired cross section through the two opposite sides of the material being joined to each other in a longitudinal overlap joint. One end of the tube is given any form of bottom closure through fold forming and sealing of the bottom field of the material delimited by means of fold lines. The tube provided with a bottom is filled with the desired contents through its open top end which is thereafter closed through what is known as bellows folding of the corresponding top field delimited by means of fold lines to form a roof ridge shaped top closure (known as gable top). A well known example of such a packaging container is Tetra Rex (reg. trade mark).

From a prefabricated material provided with fold lines and a decoration, packagings of the known type Tetra Top (reg. trade mark) are also manufactured. The packaging containers are manufactured through two opposite sides of the material being joined to each other in an overlap joint to form a tube with square, rectangular or any other desired cross section, after which the top end of the tube is closed with the aid of a plastic lid which is injection molded in place and, through surface fusion with the plastic in the material of the tube, is joined to the end of the tube in a mechanically strong, liquid-tight sealing seam around the whole opening contour of the end of the tube. The tube thus closed is filled with the contents in question and given any form of bottom closure through fold forming of the bottom field of the material delimited by means of fold lines.

From a plastically deformable, flexible material of the type described in, for example, the two previously mentioned European patent applications, packaging containers can also be produced through other mechanical shape processing than fold forming. For example containers provided with a bottom are manufactured through injection moulding or vacuum forming processes in which flat material is shaped with the aid of vacuum which pulls the material against mould surfaces in a vacuum mould shaped according to the desired container shape.

Whether the packaging container is manufactured through fold forming, vacuum forming, injection moulding or some other mechanical shape processing, it is usual for the container produced to exhibit two or more longitudinal edges which delimit between them in pairs mainly flat side walls or parts of walls. A packaging container of the type Tetra Brik or Tetra Rex thus has four longitudinal edges which delimit four flat side walls facing each other in pairs, while a packaging container of the type Tetra Top can have four longitudinal edges which delimit at the lower end of the packaging containers four wall sections facing each other in pairs which change in an upward direction into a tubular part of the container with a circular or other edgeless cross section.

The requirement set for these so-called disposable packaging containers is that they must be easy to manufacture and easy to handle in both transport and use and that they must be sufficiently rigid in form and stable in dimensions to resist external stresses to which the packaging containers are subjected during normal transport and handling. For example the packaging containers must be able to be gripped easily with the hand around two longitudinal edges serving as grip supports without the risk of the packaging container wall being deformed or cracked under the pressure of a grip by a hand. Even if the known packaging containers are normally sufficiently mechanically strong and form stable to resist external stresses during transport and handling connected with it, it not infrequently happens that the side walls of the packaging containers used as gripping surfaces are seriously deformed towards the longitudinal gripping edges and/or that the edges are cracked and thereby make the packaging container impossible to handle or very difficult to handle when it is gripped and lifted in conjunction with its being emptied of its contents. The problem can be avoided through making the packaging wall thicker, but this would entail reducing the packaging material's flexibility and with it the material's formability, with fold forming of the material made more difficult as a result. An increase in the material thicknesses would also entail an increased material consumption and thereby increased material cost for the packaging container.

OBJECTS AND SUMMARY OF THE PRESENT INVENTION

An aim of the present invention is therefore to provide a packaging container that substantially avoids the problem of deformation and/or cracking without increasing material usage or increased material costs connected with it.

Another aim is to provide a packaging container which is easy to manufacture and which is sufficiently rigid in form and stable in form to be able to be gripped conveniently with the hand without the risk of deformation and/or cracking.

These and other aims and advantages are achieved according to the invention through the packaging container being given the characteristic that the aforesaid side wall or at least one of the aforesaid side walls in the region of its two delimiting edges exhibits edge reinforcing or edge stiffening elements formed through plastic deformation of the wall material.

Further practical and advantageous embodiments of packaging containers according to the invention have further been given the characteristics given in the subclaims below.

BRIEF DESCRIPTION OF THE DRAWINGS

The invention will be described below in greater detail with particular reference to the enclosed drawings in which.

DETAILED DESCRIPTION OF THE PREFERRED EMBODIMENT

Figure 1:
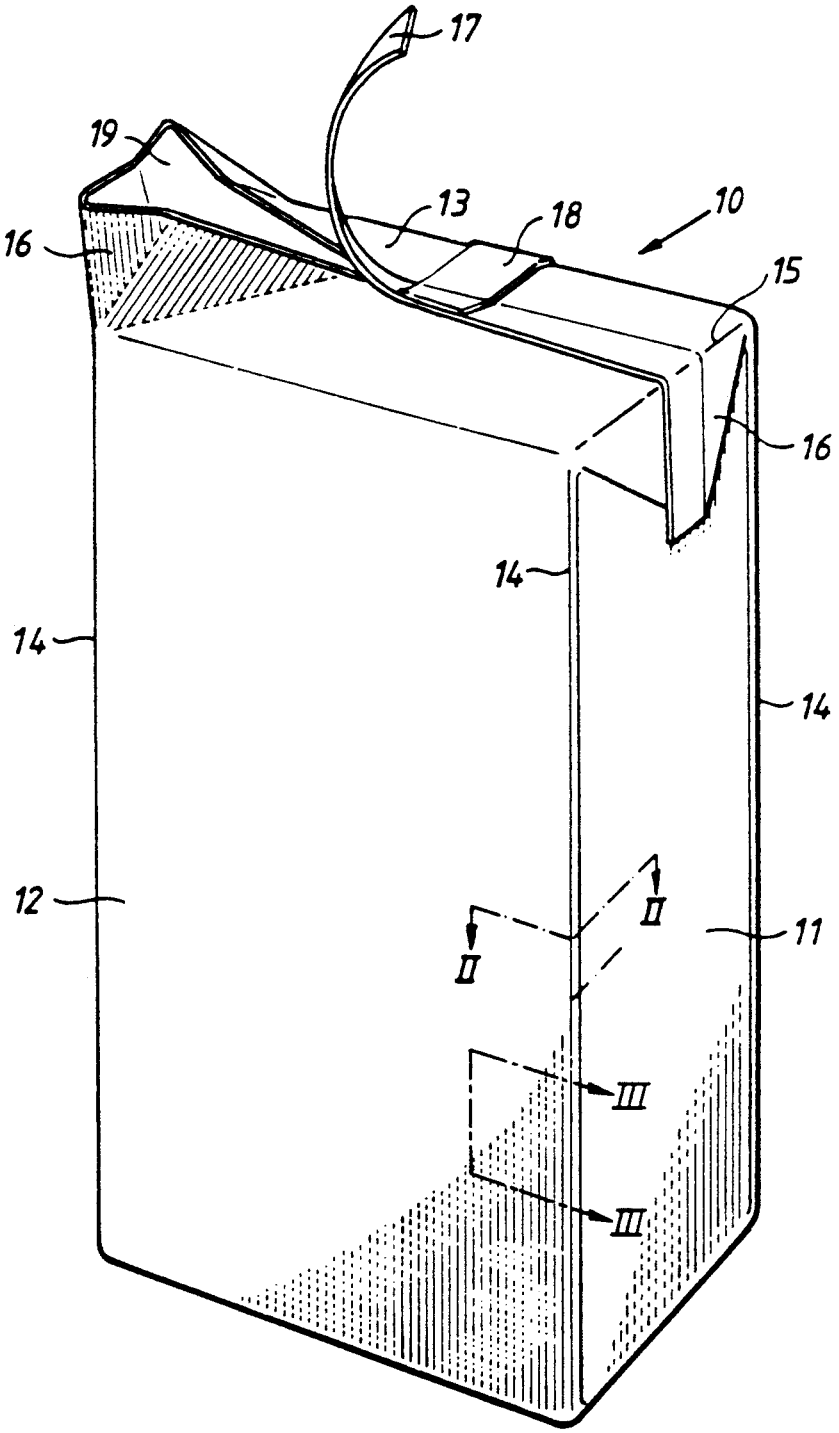
FIG. 1 is a schematic perspective view of an opened packaging container of conventional type.

The packaging container, which is given the general reference designation 10 in FIG. 1 is a cubic container body with two pairs of side walls 11 and 12 a flat bottom (not shown) and a flat openable top wall 13. The side walls 11 and 12 connect with each other at longitudinal container edges 14 which delimit between them in pairs the mainly flat side walls 11 and 12 respectively.

As can be seen from FIG. 1 the packaging container 10 has double-wall triangular corner flaps 16 located on two opposite sides 15 of the top wall 13, with a sealing fin 17 extending from the tip of one corner flap to the tip of the other corner flap across the top wall, in which the wall material is joined inside to inside in a sealing seam closing the top wall 13.

The packaging container 10 is manufactured, as described earlier, from a strip of a plastically deformable, flexible packaging material provided with fold lines and provided with decoration, through the strip first being formed into a tube through the two longitudinal edges of the strip being joined to each other in a longitudinal overlap joint 18 (a part of which is shown in FIG. 1). The tube is filled with contents and separated into closed filled packaging units through repeated transverse sealings of the tube across the longitudinal direction of the tube below the level of contents of the tube. The cushion shaped packaging units are separated from each other through cuts in the transverse sealing zones and given the desired parallelpiped-shaped final form of the packaging container 10 through a further forming and sealing operation during which the two upper double-wall corner flaps 16 of the packaging containers are folded down towards and sealed to the respective neighboring, opposite-facing side walls 11.

When the packaging container 10 is to be opened, one of the folded down corner flaps 16 (the left-hand one in FIG. 1) is freed and lifted to a position corresponding to the one which is shown in FIG. 1, after which the sealing fin 17 closing the top wall is torn off to free a spout shaped opening 19 through which the container can be emptied of its contents. The actual emptying occurs, in general, in such a way that the packaging container 10 is gripped with the hand around longitudinal edges 14 which serve as grip supports in the right-hand side wall 11. When the packaging container 10 is gripped, not only the two longitudinal gripping edges 14 but also the adjacent side walls 12 are subjected to very high stresses which not infrequently can be so great that both the side walls 12 and the edges 14 deform and/or also crack.

Figure 2:
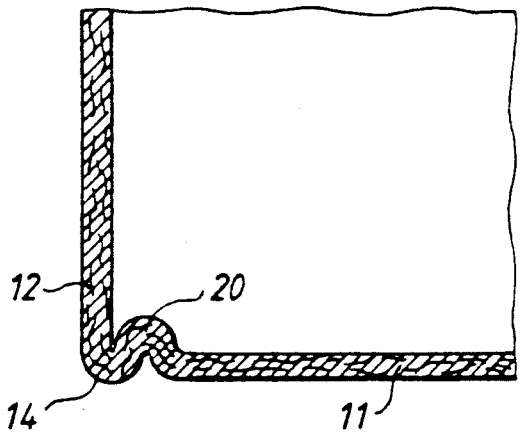
FIG. 2 is a cross sectional view taken along the line II—II in FIG. 1.
Figure 3:
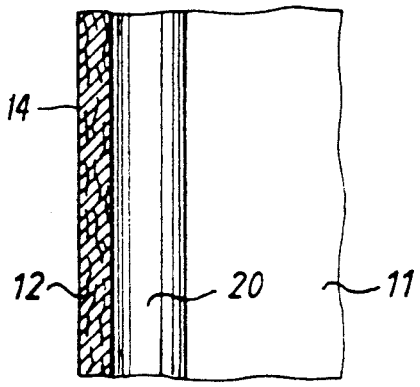
FIG. 3 is a cross-sectional view taken along the line III—III in FIG. 1.

In order to avoid the risk of deformation and/or cracking during emptying of the container, the side wall 11 facing away from the opening 19 and serving as a gripping surface is provided with edge reinforcing or edge stiffening elements 20 (FIGS. 2 and 3), formed through plastic deformation of the wall material, along at least one of the two edges 14 limiting the side wall. The elements 20 can have the form of an unbroken straight ridge projecting towards the inside of the packaging container, which extends along the whole edge 14 from the bottom to the top wall.

Figure 4:
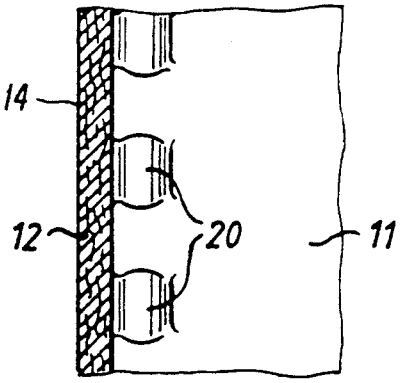
FIG. 4 is a cross-sectional view of an edge of a packaging container according to another embodiment of the invention.

In FIG. 4 it is shown how the reinforcing and stiffening elements can be shaped according to another embodiment of the invention. For clarity's sake, the same reference designations have been used for identical container details. According to this embodiment the elements 20 thus consist of pointed or tap shaped excrescences in the material, formed through plastic processing, of such individual size and spacing from each other along the edge 14 that the desired strengthening and support function is achieved. Preferably the supporting elements 20 are arranged along the whole edge 14 from the bottom to the top wall.

Figure 5:
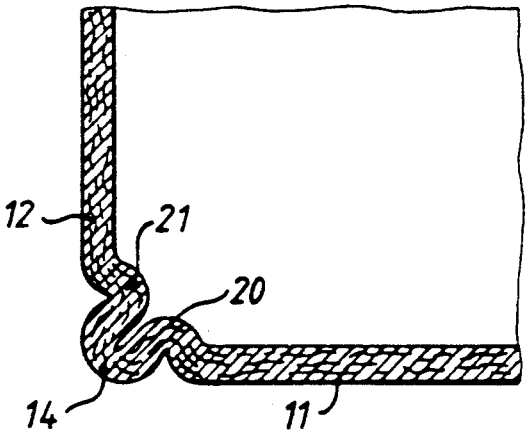
FIG. 5 is a cross-sectional view of an edge of a packaging container according to a further embodiment of the invention.

FIG. 5 shows a further example of how the supporting elements can be shaped according to the invention. As in the previously described example according to FIGS. 2 and 3, the side wall 11 is formed with a straight ridge 20, formed by plastic deformation, along the whole edge 14, and adjacent side wall 12 also is formed with a similar straight ridge 21 formed by plastic deformation which, in conjunction with the ridge 20, gives the edge 14 reinforced support. Neither the ridge 20 nor the ridge 21 needs to have the unbroken form shown in FIG. 5; they can also be pointed or tap shaped, provided that each pair of opposite pointed or tap shaped elements 20 and 21 is arranged along the same part of the edge 14 and situated centrally to each other so as to be able to work in conjunction with each other.

The material in the packaging container according to the invention preferably comprises a stiffening skeletal layer of plastic and filler mixed in the plastic, of the kind described in the two European patent applications EP-A-O 353 991 and EP-A-O 353 496. The plastic consists of a polyolefine such as polythene, polypropylene etc., preferably a polypropylene plastic. Specially preferred polypropylene plastics are a propylene homopolymer with a melting index of under 10 according to ASTM (2.16 kg; 230° C.) or an ethylene/propylene copolymer with a melting index of between 0.5 and 5 according to ASTM (2.16 kg; 230° C.). Between these two preferred polypropylene plastics, the ethylene/propylene copolymer is the most preferred, since it exhibits excellent sealing and strength properties, even at low temperatures, e.g. 8° C. and lower.

The filler can be any known granular or flaked filler in the field, such as chalk, mica, talc, clay etc. The amount of filler can be between 50 and 80% of the total weight of the skeletal layer, and is preferably approximately 65 weight %, which gives the material good rigidity and formability without making the material brittle and fragile.

As previously mentioned, the elements shaped for the purpose of reinforcing and stiffening are obtained through plastic deformation which can suitably be carried out in conjunction with extrusion of the skeletal layer consisting of plastic and filler. The plastic deformation is suitably carried out with the use of the same cylinders as in the folding of the material, which only requires an insignificant modification of the already existing production equipment and which, in addition, effectively makes use of the circumstance that the extruded material is still sufficiently soft and formable immediately after extrusion.

In accordance with the present invention it is thus possible easily and with simple means to avoid the problem of deformation and cracking of packaging containers through making use of the packaging material's plastic deformability during production of the material. The production of the material only requires a small modification of already existing production equipment. Further the plastically deformable material used for the manufacture is very cheap owing to a large weight content of filler.

It must be finally observed that, even if the invention has been described specially with reference to a single known type of packaging which is shown in the enclosed drawings, the invention can of course also be applied to any other known type of packaging container comprising a tubular container section with longitudinal edges. The packaging container does not need to be manufactured through fold forming either, but can be manufactured through other mechanical shape processing such as thermo-forming, injection moulding, vacuum forming etc. For the specialist it is further obvious that minor modifications of one or more of the specially described container details are possible within the framework of the concept of the invention as defined in the patent claims below. For example, the ridges shaped as reinforcing and stiffening elements must, whether they have an unbroken linear extent or are shaped as pointed or tap shaped excrescences in the material, be arranged along the whole longitudinal edge of the container. In certain cases, it is quite sufficient to arrange the ridges along only part of the edge, preferably in a central region between the lower and upper end walls of the container where the container is normally gripped. In addition, it is of course possible and sometimes even advantageous to provide the packaging container with such reinforcing and stiffening elements along all the longitudinal edges of the container.

While this invention has been illustrated and described in accordance with a preferred embodiment, it is recognized that variations and changes may be made therein without departing from the invention as set forth in the claims.

What is claimed is:

1. Packaging container, manufactured from a plastically deformable, flexible material, comprising:

a tubular container body having at least two longitudinal edges which delimit between them a mainly flat side wall; and one or more reinforcing elements formed in the tubular container body in a corresponding number of regions near a corresponding number of the longitudinal edges, the reinforcing elements including one or more plastic deformations in the material which reinforce the corresponding number of longitudinal edges.

2. Packaging container according to claim 1, wherein the one or more reinforcing elements are formed as unbroken, straight excrescences in the material on an inside of the side wall.

3. Packaging container according to claim 1, wherein the one or more reinforcing elements are formed as pointed excrescences in the material on an inside of the side wall.

4. Packaging container according to claim 1, wherein the one or more reinforcing elements are arranged along the corresponding number of the longitudinal edges from a top to a bottom wall of the packaging container.

5. Packaging container according to claim 1, wherein reinforcing elements are arranged along all of the longitudinal edges.

6. Packaging container according to claim 1, wherein the packaging material is manufactured from a plastically deformable material comprising one or more layers of plastic and filler mixed in plastic.

7. Packaging container according to claim 6, wherein the plastic and filler form a skeletal layer in which the plastic is a polyolefin and wherein the amount of filler is between 50 and 80% of the total weight of the skeletal layer.

8. Packaging container according to claim 6, wherein the plastic is a propylene homopolymer.

9. Packaging container according to claim 6, wherein the filler includes chalk.

10. Packaging container according to claim 6, wherein the plastic is an ethylene/propylene copolymer.

11. Packaging container according to claim 6, wherein the filler includes mica.

12. Packaging container according to claim 6, wherein the filler includes talc.

13. Packaging container according to claim 6, wherein the filler includes one or more of chalk, mica, and talc.

14. Packaging container according to claim 1, further comprising a top and a bottom transverse sealing seam at a top and a bottom wall, respectively, of the tubular container body formed by sealing an inner surface of the tubular container body to itself at the top and the bottom walls of the tubular container body, the top sealing seam forming a sealing fin sealing the top wall.

15. Packaging container manufactured from a plastically deformable material, comprising:

a tubular container body having at least two longitudinal edges which delimit between them a mainly flat side wall of the container, the side wall being plastically deformed to form one or more reinforcing elements in a corresponding number of regions near a corresponding number of the longitudinal edges, the reinforcing elements being arranged along only a central part of the corresponding number of longitudinal edges.

16. Packaging container according to claim 15, wherein the packaging material is manufactured from a plastically deformable material comprising one or more layers of plastic and filler mixed in the plastic.

17. Packaging container according to claim 16, wherein the plastic and filler form a skeletal layer in which the plastic is a polyolefin and wherein the amount of filler is between 50 and 80% of the total weight of the skeletal layer.

18. Packaging container according to claim 16, wherein the plastic is a propylene homopolymer.

19. Packaging container according to claim 16, wherein the plastic is an ethylene/propylene copolymer.

* * * * *